United States Patent [19]

Benteler et al.

[11] 4,331,016

[45] May 25, 1982

[54] TUBE BENDING APPARATUS WITH ELONGATED INNER MANDREL

[75] Inventors: Hubertus Benteler, Bielefeld; Wolfgang Streubel, Paderborn; Egon Olszewski, Paderborn-Elsen, all of Fed. Rep. of Germany

[73] Assignee: Benteler-Werke A.G., Paderborn, Fed. Rep. of Germany

[21] Appl. No.: 126,833

[22] Filed: Mar. 3, 1980

[30] Foreign Application Priority Data

Mar. 8, 1979 [DE] Fed. Rep. of Germany ..... 2908996

[51] Int. Cl.[3] ..... B21D 9/05

[52] U.S. Cl. ..... 72/133; 72/150; 72/307

[58] Field of Search ..... 72/133, 149, 150, 307

[56] References Cited

U.S. PATENT DOCUMENTS

| | | | |
|---|---|---|---|
| 2,565,971 | 8/1951 | Kitlica | 72/133 |
| 3,273,364 | 9/1966 | Pohler et al. | 72/133 |
| 3,280,612 | 10/1966 | Schmidt | 72/298 |
| 3,287,952 | 11/1966 | VanHarten | 72/150 |

*Primary Examiner*—Lowell A. Larson
*Attorney, Agent, or Firm*—Michael J. Striker

[57] ABSTRACT

A tube bending apparatus comprises an elongated mandrel having a length at least three times the length of a tube to be bent in the apparatus. A first mandrel holder is arranged at the rear end of the mandrel and a second mandrel holder is forwardly spaced from said first by a distance slightly greater than the length of a tube. Each of the mandrel holders comprises a pair of clamping jaws and a fluid operated cylinder-and-piston unit connected to each clamping jaw for alternatingly moving the clamping jaws of the first and the second mandrel holder between a closed position engaging the mandrel and an open position permitting a tube about the mandrel to be moved in axial direction by a plurality of transport rollers into an axially movable slide provided with a clamping collet so that a tube clamped in the region of the rear end thereof by the clamping collet is during forward movement of the slide moved into a bending mechanism arranged in the region of the front end of the mandrel and bent during operation of the bending mechanism. The bent tube is pushed out in forward direction from the mandrel while the collet is open as a second tube located between the second mandrel holder and the slide is moved into the latter to be clamped by the collet and a third tube located between the mandrel holders is transported between the slide and the second mandrel holder while the latter is opened and the first mandrel holder is closed.

10 Claims, 1 Drawing Figure

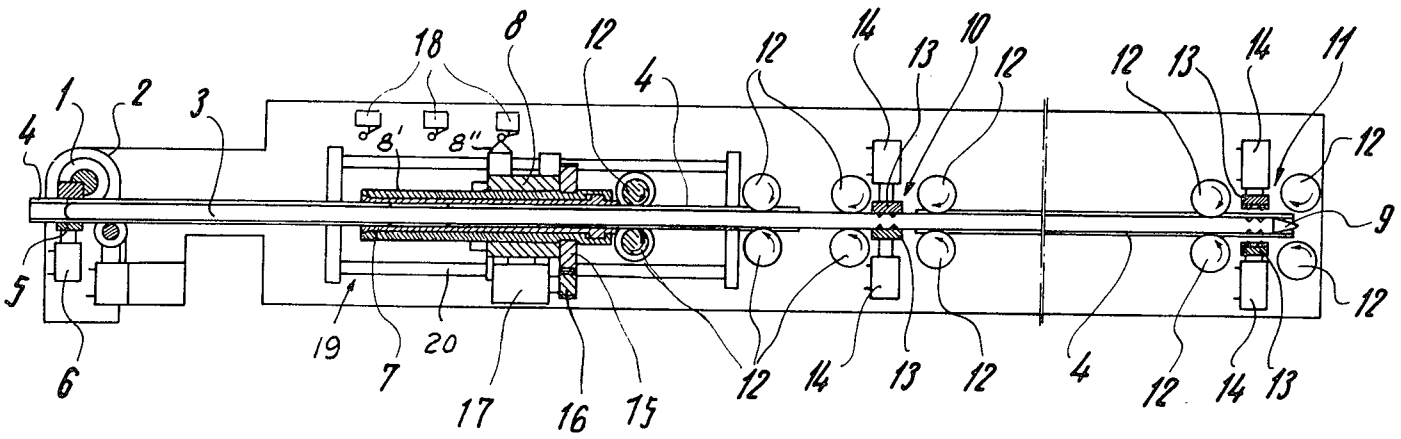
1
2
3
4
5
6
7
8
8'
8''
9
10
11
12
13
14
15
16
17
18
19
20

TUBE BENDING APPARATUS WITH ELONGATED INNER MANDREL

BACKGROUND OF THE INVENTION

The present invention relates to a tube bending apparatus with an inner mandrel for the tube to be bent.

Tube bending apparatus with an inner mandrel for the tube to be bent are well known in the art.

The known tube bending apparatus have, however, the disadvantage that the tube to be bent can be moved only from the front end of the mandrel onto the same so that a continuous operation of the apparatus is not possible.

In order to carry out one or a plurality of bending operations the tube has to be moved from the front end of the mandrel in one direction onto the same, whereas after the bending operations have been performed, the bent tube is to be moved in the opposite direction over the front end of the mandrel away from the same and subsequently transported further.

SUMMARY OF THE INVENTION

It is an object of the present invention to provide a tube bending apparatus with an inner mandrel which is constructed in such a manner to permit movement of the tube into the bending mechanism of the apparatus in one direction and movement of the bent tube in the same direction out of the apparatus whereby, as compared with tube bending apparatus known in the art, a considerable increase of the output of the apparatus is obtained.

With these and other objects in view, which will become apparent as the description proceeds, the tube bending apparatus according to the present invention mainly comprises a mandrel having a length at least three times the length of a tube to be bent in the apparatus, tube bending means in the region of the front end of the mandrel, a pair of mandrel clamping means, one in the region of the rear end of the mandrel and the other forwardly spaced therefrom by a distance at least equal to the length of a tube, for alternatingly clamping the mandrel, a slide movable in axial direction of the mandrel, a collet carried by the slide for clamping a tube surrounding the mandrel in the region of the rear end of the tube while a portion of the tube is engaged by the tube bending means to be bent thereby, and a plurality of transport rollers between the rear end of said mandrel and the slide for transporting tubes surrounding the mandrel rearwardly of the slide into the latter.

The tube bending apparatus according to the present invention can therefore be operated in a continuous manner since during bending of a first tube, a second tube can already be placed on the inner mandrel and moved in a position of waiting. After the first tube is finish bent it will be moved over the front end of the mandrel away from the latter by further movement of the second tube on the mandrel, which is at the same time is moved into the bending means of the apparatus. Subsequently thereto, a further tube may be moved from the rear end of the mandrel into the waiting position, while the second tube is bent and so on.

The output of the tube bending apparatus according to the present invention is thereby considerably increased. While with a tube bending apparatus according to the prior art about 400 bending operations per hour can be performed, the output with the tube bending apparatus according to the present invention is about 700 bending operations per hour.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

The single FIGURE of the drawing schematically illustrates the tube bending apparatus, partly in longitudinal cross-section.

DESCRIPTION OF THE PREFERRED EMBODIMENT

Referring now to the drawing, it will be seen that the tube bending apparatus according to the present invention comprises a tube bending mechanism 1 of known construction having a bending head 2, which is turnable about an axis by means not shown in the drawing, and an elongated inner mandrel 3 extending with a front end portion into the bending mechanism 1.

The inner mandrel 3 has a length which is at least equal to three times the length of the tubes 4 to be bent in the apparatus. As shown in the drawing, one tube 4 is already in a bending position and by means of clamping jaws 5 operable in a known manner by hydraulic cylinders 6 held in the bending mechanism 1.

The rear end of the tube 4, a front portion of which is engaged by the bending mechanism 1, is clamped in a clamping collet 7 of a slide 8 guided for movement in axial direction by guide rods 20 on a stationary frame 19. The slide 8 has an inner tubular portion 8', carrying the collet 7, and being turnable about the axis of the mandrel 3. The tubular portion 8' may be turned about this axis by a gear 15 fixedly connected thereto and meshing with a pinion 16 on the output shaft of a servomotor 17 movable together with the slide 8 in axial direction of the same. The slide 8 has a projection 8'' cooperating with a plurality of axially displaced limit switches 18 connected in circuit with drive means of known construction, not shown in the drawing, for limiting the forward movement of the slide 8. In this way a plurality of bends may be formed in the tube 4 engaged by the bending mechanism by turning for each bend the bending head 2 together with the clamping jaws 5 and the operating cylinder 6 about the axis of the head 2 and by successively moving the slide 8 after each bend along a forward stroke determined by the limit switches 18 and such bends may be located in different planes by turning the tubular portion 8' of the slide by the servomotor 17 about its axis. The collet 7 is moved between a clamping and an inactive position by fluid operated means incorporated in the tubular portion 8' of the slide.

The rear end of the inner mandrel 3 is pointed as shown at 9 to facilitate pushing of tubes 4 onto the mandrel 3.

A pair of mandrel holders 10 and 11 are arranged in the region of a rear portion of the inner mandrel 3. The distance between the two mandrel holders 10 and 11 is slightly greater than the length of a tube 4 to be bent.

Each of the mandrel holders 10 and 11 comprises a pair of clamping jaws 13, respectively arranged to opposite sides of the mandrel, and a hydraulically operated cylinder-and-piston unit 14 for each of the clamping jaws 13 for moving the same between an active position engaging the mandrel 3, and an inactive position permitting a tube 4 to be pushed through the open clamping jaws.

In the position shown in the drawing, the rear mandrel holder 11 is shown in the open position, whereas the mandrel holder 10 is shown in the closed position and holds therewith the mandrel 3 in stationary position. Since the rear mandrel holder 11 is open, a tube 4 may be pushed onto the mandrel 3. A plurality of transport rollers 12 are arranged longitudinally spaced from each other along the mandrel by means of which a tube 4 may be transported in the direction toward the bending mechanism 1. As shown in the drawing, there are two pairs of transporting rollers 12 arranged at opposite sides of each mandrel holder 10 and 11 and two additional pairs of transport rollers 12 are arranged between the mandrel holder 10 and the slide 8. As shown in the drawing, there is a further tube 4 arranged about the mandrel 3 in waiting position between the mandrel holder 10 and the slide 8. The transport rollers 12 are stepwise driven in the direction as indicated by the arrows by drive means not shown in the drawing, in sequence with the operation of the mandrel holders 10 and 11 and the collet 7.

After all the desired bending operations have been carried out on the front tube 4, the collet 7 is opened and the bent tube is moved beyond the front end of the mandrel by moving the following tube shown in waiting position by the transporting rollers into the bending mechanism 1.

The slide 8 is now moved back to its starting position, whereafter the collet 7 is closed so that the rear end of the tube now engaged by the bending mechanism 1 will be clamped by the collet. Thereafter the rear mandrel holder 11 is closed and the mandrel holder 10 is opened, so that the tube 4 located between the two mandrel holders 10 and 11 may be moved to the waiting position between the mandrel holder 10 and the collet 7. Thereafter, the mandrel holder 10 is closed again and the mandrel holder 11 is opened so that a new tube may be moved onto the rear end portion of the mandrel 3.

By alternating the holding of the mandrel 3 by means of the two mandrel holders 10 and 11 it is possible to move the tubes to be bent in only one direction along the mandrel 3, which leads to a considerable increase of the output of the tube bending apparatus according to the present invention.

It is to be understood that the sequence of operation of the various elements of the apparatus that is the operation of the cylinder-and-piston unit 14 for moving the mandrel holders 10 and 11 between an active and inactive position, the stepwise rotation of the transport rollers 12 and opening and closing of the collet 7 may be controlled by limit switches or other means well known in the art in dependence on the operation of the bending mechanism 1.

It will be understood that each of the elements described above, or two or more together, may also find a useful application in other types of bending machines differing from the types described above.

While the invention has been illustrated and described as embodied in a tube bending machine having an inner mandrel of a length at least two times the length of a tube to be bent it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A tube bending apparatus comprising a mandrel having a front end and a rear end and a length at least three times the length of the tubes to be bent in the apparatus; tube bending means in the region of said front end of said mandrel; a pair of mandrel clamping means, one in the region of the rear end of the mandrel and the other forwardly spaced from said one clamping means by a distance slightly greater than the length of a tube for alternatingly clamping said mandrel; a slide movable in axial direction of said mandrel and located between said tube bending means and said other mandrel clamping means; collet means carried by said slide for clamping a tube surrounding the mandrel in the region of the rear end of the tube a portion of which is engaged by said tube bending means to be bent thereby; and a plurality of transport rollers between said rear end of said mandrel and said slide for transporting tubes surrounding the mandrel rearwardly of the slide into the latter.

2. A tube bending apparatus as defined in claim 1, wherein each of said mandrel clamping means comprises a pair of clamping jaws arranged at opposite sides of said mandrel and means for moving said clamping jaws between an operative position engaging said mandrel and an inactive position permitting a tube to be moved past said clamping means.

3. A tube bending mechanism as defined in claim 2, wherein said means for moving said clamping jaws comprise fluid operated cylinder-and-piston means.

4. A tube bending apparatus as defined in claim 1, wherein said rear end of said mandrel is pointed.

5. A tube bending apparatus as defined in claim 1, wherein said slide is axially movable between a forward and a rearward end position and wherein the distance of said collet means carried by said slide, when the latter is in said rearward end position, from said other mandrel clamping means is at least equal to the length of a tube to be bent in the apparatus.

6. A tube bending apparatus as defined in claim 1, wherein said slide includes an inner tubular portion carrying said collet and means for turning said inner tubular portion of the slide about the axis of said mandrel.

7. The tube bending apparatus as defined in claim 6, and including a stationary frame having guide rods extending parallel to said mandrel for guiding said slide movable in axial direction between two end positions, said means for turning the tubular inner portion of said slide comprising a motor axially movable with said slide, a pinion driven by said motor and a gear coaxially fixed to said inner tubular portion of said slide and meshing with said pinion.

8. A tube bending apparatus as defined in claim 7, wherein said inner tubular portion of said slide closely surrounds a portion of said mandrel and prevents the latter from movement in a direction transverse to its axis.

9. A tube bending apparatus as defined in claim 1, wherein said plurality of transport rollers comprises two pairs of transport rollers respectively arranged to opposite sides of each mandrel clamping means and two additional pairs of transport rollers spaced in axial direction from each other between said slide and said other mandrel clamping means.

10. A tube bending apparatus as defined in claim 1, wherein said mandrel has throughout its length, with the exception of the front and rear ends thereof, a uniform cross-section.

* * * * *